United States Patent [19]

Hirano

[11] Patent Number: 4,964,799

[45] Date of Patent: Oct. 23, 1990

[54] HEATING FURNACES

[76] Inventor: Bunzo Hirano, 539, Nishinoshima, Toyoda-Cho, Iwata-Gun, Shizuoka-Ken, Japan

[21] Appl. No.: 168,551

[22] Filed: Mar. 4, 1988

Related U.S. Application Data

[63] Continuation of Ser. No. 865,077, May 19, 1986, abandoned.

[51] Int. Cl.[5] ..... F27B 9/28; F27B 7/00

[52] U.S. Cl. ..... 432/59; 432/194; 432/249

[58] Field of Search ..... 432/150, 133, 143, 162, 432/194, 207, 212, 249, 59

[56] References Cited

U.S. PATENT DOCUMENTS

| | | | |
|---|---|---|---|
| 1,832,226 | 11/1931 | Loesche | 432/150 |
| 2,160,610 | 5/1939 | Witting | 432/143 |
| 3,514,084 | 5/1970 | Morin | 432/249 |
| 4,385,945 | 5/1983 | Compton et al. | 432/59 |
| 4,586,899 | 5/1986 | Takahashi | 432/194 |

FOREIGN PATENT DOCUMENTS

| | | |
|---|---|---|
| 58-12513 | 3/1983 | Japan . |
| 59-42225 | 10/1984 | Japan . |

*Primary Examiner*—Henry C. Yuen

*Attorney, Agent, or Firm*—Bruce L. Adams; Van C. Wilks

[57] ABSTRACT

A heating furnace comprises a horizontal body portion, a source of heat located at an intermediate portion of the body portion for forming hot gas which circulates in the body portion by natural convection, a gas discharge port formed in the wall of the body portion, a gas collecting hood connected to the lower end of an exhaust cylinder, and a horizontal conveyor for conveying an article to be heated through the furnace. The opposite ends of the body portion act as the inlet and outlet ports as well as gas discharge ports. In one embodiment, upper half portions of the inlet and outlet ports are covered by shielding plates. In another embodiment the opposite ends of the body portion are inclined downwardly to form the inlet and outlet ports near or below the bottom surface of the furnace. In still another modification, air curtains are formed at the inlet and outlet ports.

8 Claims, 4 Drawing Sheets

HEATING FURNACES

This is a Rule 62 continuation application of parent application Ser. No. 865,077 filed May 19, 1986 now abandoned.

BACKGROUND OF THE INVENTION

1. Field of the Art

This invention relates to a heating furnace of the natural convection type in which an article is heated while it passes through the furnace.

2 Description of the Prior Art

A heating furnace of the type may have a heat source which is suitable from the viewpoints of heating efficiency, stability, uniformity and safety. The heating furnace which is heated by burning a liquid or gaseous fuel by a burner and introducing the combustion gas directly into the furnace have economic advantages of high carolies, simple installations, easy handling, etc. On the other hand, since heat is carried by the combustion gas into the furnace to heat articles, a large quantity of combustion gas has to be introduced into the furnace. This causes the same quantity of gas to be discharged from the furnace. Unless the replacement is efficient, the fuel is wasted. Then especially significant problem exists in the manner by which inlet and outlet ports for an article to be carried by a conveyor line are provided in the furnace.

In view of this, there has been proposed the circulation method of recovering the heated gas discharged from the furnace and forcing it back into the furnace. This method requires installations, such as a blower for the circulation and ducts, or a heat-exchanger. This disadvantages of such circulation method are increased numbers of components and complicated structure. In the case where such circulation method is used in the heating furnace for backing paint coating, the thinner evaporated from the paints becomes denser while circulated, and unpreferably makes painted surfaces opaque. If the thinner becomes much denser, there will be a hazard of explosion. In order to prevent these situations, air has to be added to make the thinner less denser. Besides, the heat dispersion from the ducts for the circulation is large, and no heat efficiency increase is attained.

There are cases in which the furnace body has to be long in view of a relationship between a speed of the conveyor line and a required heating time. In such cases, the furnace body may be inverted-cup-shaped. In such furnace body, however, the flow of the exhaust gas is so fast that turbulent flows are generated in the furnace body with the result that the temperature distribution becomes nonuniform, and the stable heating is accordingly impossible. Even in such a case, a uniform temperature distribution can be managed to some extent by contriving to arrange the burner. Depending on heating temperatures (fuels), however, it cannot be managed, where more gas stagnates in the central portion of the furnace body, and in the case that the heating furnace is used for baking paint coatings, the bad effect to painted surfaces and hazards of explosions described above are present.

In a heating furnace of the type wherein an article is heated by introducing into the furnace such hot gas as combustion gas produced by a gas burner or gas heated by an electric heater, since a large quantity of hot gas is constantly introduced into the furnace, the same quantity of the gas is exhausted. For this reason the heat efficiency of the furnace can be improved by decreasing as far as possible the heat quantity removed from the furnace by the exhaust gas. According to a preferred method, hot gas is sequentially admitted into an inverted-cup-shaped furnace for discharging from the lower portion of the furnace the gas whose temperature has decreased by natural convection. With this construction, high temperature gas always fills the upper portion of the furnace and cooled gas is discharged so that a high heating efficiency can be realized. Typical examples of the furnaces of this type are disclosed in Japanese Patent Publication Nos. 12513/1983 and 42225/1984 filed by the same applicants as this invention, the latter being shown in FIG. 8 of this application. As shown in FIG. 8, the heating furnace comprises a main body having a top horizontal portion a and downwardly inclined side portions having inlet/exit ports b and c, a conveyor d for conveying article e to be heated through the furnace, and a source of heat g (which may be a gas burner, a steam heater or an electric heater) located on the bottom wall f of the horizontal portion a. The upper edges of the inlet/outlet ports b and c are located at the same or a little higher level than the bottom wall f. With this construction, the gas of the lowest temperature is discharged through the inlet/outlet ports b and c and the interior of the furnace is filled with high temperature gas, thereby efficiently heating the article e.

Although the heating furnace shown in FIG. 8 can efficiently utilize the cross-sectional area of the furnace, it is relatively difficult to install the source of heat and the belt conveyor. In addition, maintenance of the furnace is difficult and expensive.

SUMMARY OF THE INVENTION

Accordingly, it is an object of this invention to provide an improved heating furnace capable of improving the heat efficiency of natural convection, and the furnace can eliminate waste heating space and save heating power, that is fuel or electric power.

According to this invention, there is provided a heating furnace comprising a horizontal body portion having inlet and outlet ports at opposite ends thereof, a source of heat located at an intermediate portion of the body portion for forming hot gas which circulates in the body portion by natural convection, at least one gas discharge port formed in the wall of the body portion, at least one gas collecting hood connected to the lower end of a gas exhaust cylinder, and conveyor means extending horizontally through an inner upper portion of the body portion for conveying an article to be heated through the heating furnace. The opposite ends of the body portion act as the inlet and outlet ports as well as gas discharge ports. In one embodiment, the upper half portions of the inlet and outlet ports are covered by shielding plates, while in another embodiment, the opposite ends of the body portion are inclined downwardly to form the inlet and outlet ports near or below the bottom surface of the furnace. In still another modification, air curtains are formed at the inlet and outlet ports.

DESCRIPTION OF THE PREFERRED EMBODIMENT

Figure 1:
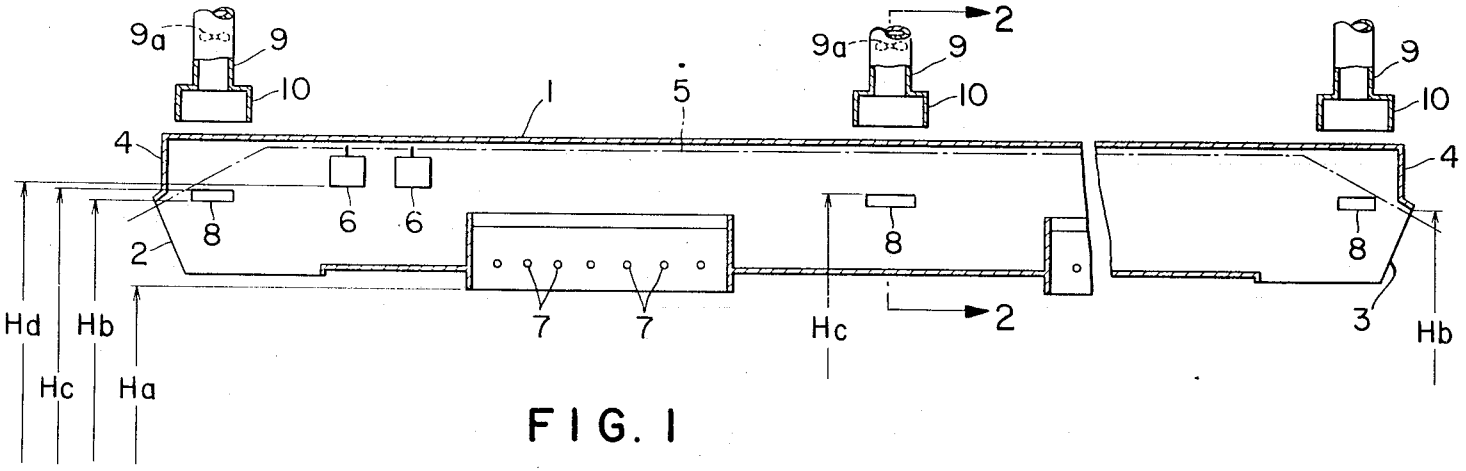
FIG. 1 is a longitudinal sectional view showing one embodiment of the heating furnace according to this invention.
Figure 2:
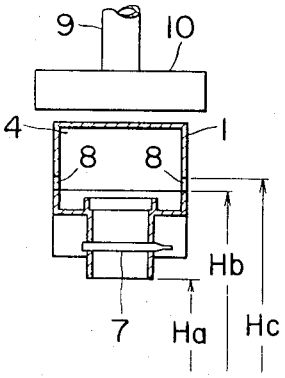
FIG. 2 is a cross-sectional view of the furnace shown in FIG. 1 taken along a line II—II.

FIGS. 1 and 2 show the basic construction of the heating furnace according to this invention. The furnace 1 is configured in the form of a horizontal tunnel or elongated horizontal chamber. The horizontal chamber defines a heating chamber having top and bottom portions and a pair of opposed side wall portions. If desired, it may be bent in the horizontal direction. The upper half portions of the inlet port or opening 2 and the outlet port or opening 3 are covered by shield plates or cover members 4 with their lower edges bent outwardly. In the furnace 1 is installed a conveyor line 5 for conveying or transporting articles 6 to be heated from the inlet port 2 to the outlet port 3. The conveyor line ascends at the inlet port 2 and descends at the outlet port 3 so as to pass the articles 6 through the upper portion of the furnace 1 or a space surrounded by the upper portion and the pair of side portions of the chamber and the shielding plates. By such a construction, the cover members 4, the top portion of the heating chamber and the upper parts of the side walls of the heating chamber jointly define an enclosed heating zone in the upper region of the furnace 1. A source of heat 7 is provided in the bottom of the furnace 1. The source of heat 7 may be a gas burner or an electric heater and arranged such that the heated hot gas or air is in the furnace introduced circulated by natural convection without relying on forced circulation. Discharge ports 8 are provided near the inlet and outlet ports 2 and 3 and if desired at the central portion. A gas or air collecting hood 10 provided with an exhaust cylinder 9 is opened above each discharge port 8. An exhaust fan 9*a* is contained in each exhaust cylinder 9.

In the furnace described above, the height Ha of the upper edge of the air inlet or suction port to supply air to the gas burner 7. The height Hb of the lower edge of the shield plate 4, the height Hc of the upper edge of the discharge port 8 and the height Hd of the lower edge or end of the article 6 measured when the article 6 is transported through the furnace are set to satisfy a relation $Ha < Hb \leqq Hc \leqq Hd$.

Figure 3:
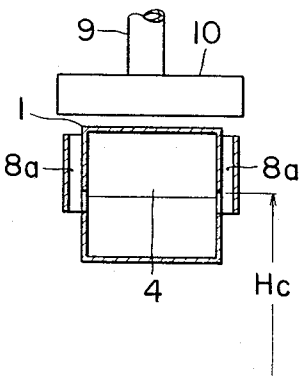
FIG. 3 is a cross-sectional view showing a modified embodiment of this invention.

Then the hot gas generated by the gas burner 7 rises upwardly to fill the enclosed heating zone within the furnace whereby due to natural convection, the gas whose temperature has been lowered by heating the article 6 is discharged to the outside of the furnace. Since the discharge port 8 has no funnel or sucking effect, the high temperature gas generated by the burner 7 can stay or be confined in the enclosed heating zone of the furnace so as to efficiently heat the article passing therethrough. As a consequence, the highest heating efficiency can be obtained and the temperature in the furnace can be readily adjusted by controlling the quantity of heat supplied by the gas burner 7 or other type of source of heat. Moreover, it is possible to maintain the temperature distribution in the furnace 1 uniform. Where it is impossible to directly form the discharge port through the side wall of the furnace, exhaust guide openings 8*a* may be formed in parallel with the side walls of the furnace 1 as shown in FIG. 3.

Figure 4:
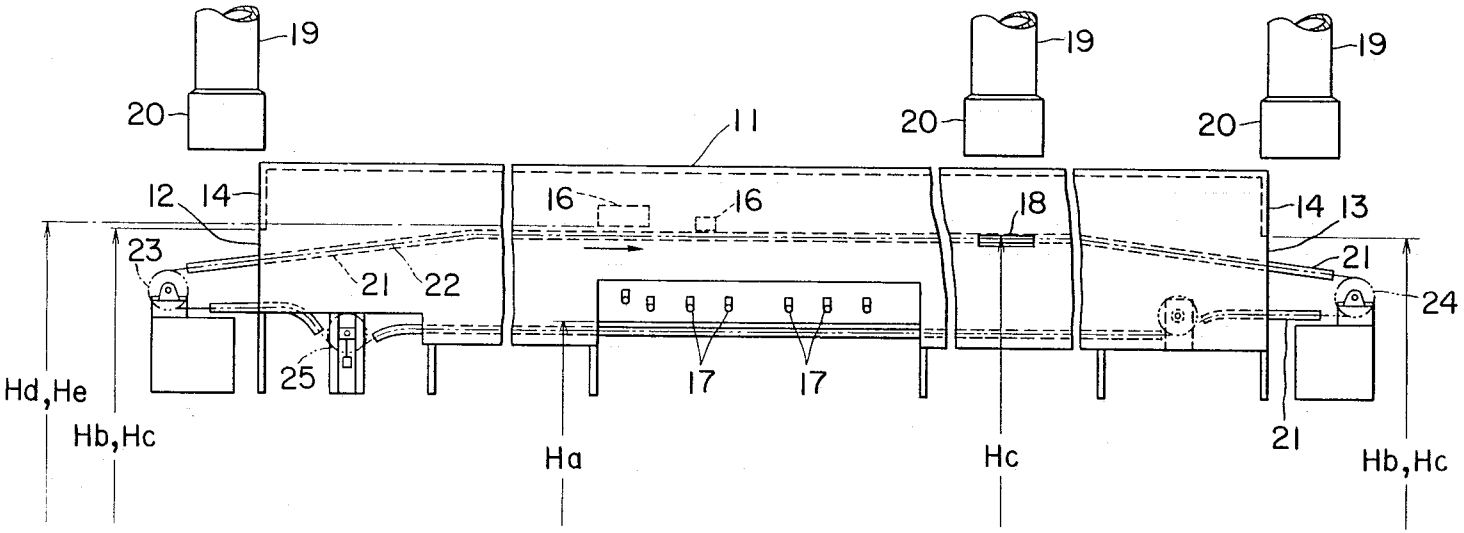
FIG. 4 is a longitudinal sectional view showing still another embodiment of this invention.

A modification shown in FIG. 4 is constructed as follows. Like the first embodiment, the upper halves of the inlet port 12 and the outlet port 13 of the furnace 11 are covered by shield plates 14, and an exhaust port 18 is formed at the central portion of the furnace. The height Hb of the lower edge of each shield plate 14 is made equal to the height Hc of the upper edge of the exhaust port 18. Then the inlet port 12 and the outlet port 13 are utilized as exhaust ports. Consequently, exhaust cylinders 19 including gas collecting hoods 20 are disposed above the inlet and outlet ports 12 and 13. A gas burner or the source of heat 17 is installed on the bottom wall of the furnace 11.

Guide rails 21 are arranged along the opposite side walls of the furnace 11 and an endless belt conveyor 22 is provided to move along the guide rails 21. The belt conveyor 22 is installed to ascend from the inlet port 12 and descend toward the outlet port 13. The height He of the conveyor 22 in the furnace 22 is made to be equal to or larger than the heights Hb and Hc of the lower edge of each shield plate 14 and upper edge of the exhaust port 18, namely, $He \geqq Hb = Hc$. The belt conveyor 22 is driven slowly in the direction of an arrow for transporting articles 16 carried thereby through the furnace 11 in a predetermined time. Irrespective of their size, the lower surfaces of the articles are aligned on the height of the upper surface of the belt conveyor 22 so as to satisfy the relation $Hb \geqq Hc = Hd$ described above, whereby the articles are transported through the space filled with the hot gas such that the articles are substantially confined within the space throughout the transportation and therefore efficiently heated. Reference numeral 23 represents a driving wheel of the belt conveyor 22 represents, 24 a driven wheel and 25 represents a potentiometer driven by the belt conveyor 22. The discharge openings 18 may be disposed at the inlet and outlet ports 12 and 13.

Figure 5:
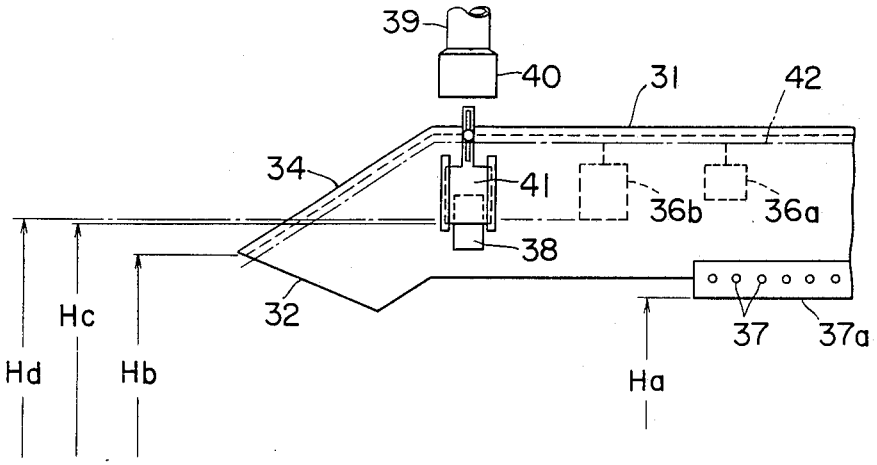
FIG. 5 is a longitudinal sectional view showing a portion of a heating furnace of still another embodiment of this invention.

In a modification shown in FIG. 5, slanting shield plates 34 are provided for an inlet port 32 and an outlet port (not shown) of a furnace 31 just like the former embodiment. The height Hb of the lower edge of each shield plate 34 and the height Ha of the lower edge of an air supply port 37*a* of a gas burner 37 have a relation $Ha < Hb$. A gas or air discharge port 38 is provided with a vertically movable adjusting plate 41. By adjusting it, the height of the upper edge of the discharge port 38 can be varied. However the discharge port 38 is positioned such that even when the adjusting plate 41 is moved to the lowest position, a relation $Hb \leqq Hc$ can be satisfied. A conveyor line 42 is extended along the upper wall of the furnace 31 and articles 36*a*, 36*b* are hung from the conveyor line. Since the heights of the lower edges of small article 36*a* and a large article 36*b* are different, the adjusting plate 41 is adjusted in the vertical direction for adjusting the lower edge of the small article 36 to the same height of the upper edge of the discharge port 38, thereby optimizing the relation $Hb \leqq Hc \leqq Hd$. This adjustment makes minimum the fuel consumption depending on the side of the article to be heated. In a furnace in which the inlet and outlet ports are utilized as the discharge ports, the heights of the lower edges of the adjusting plates are made variable in the vertical direction.

Figure 6:
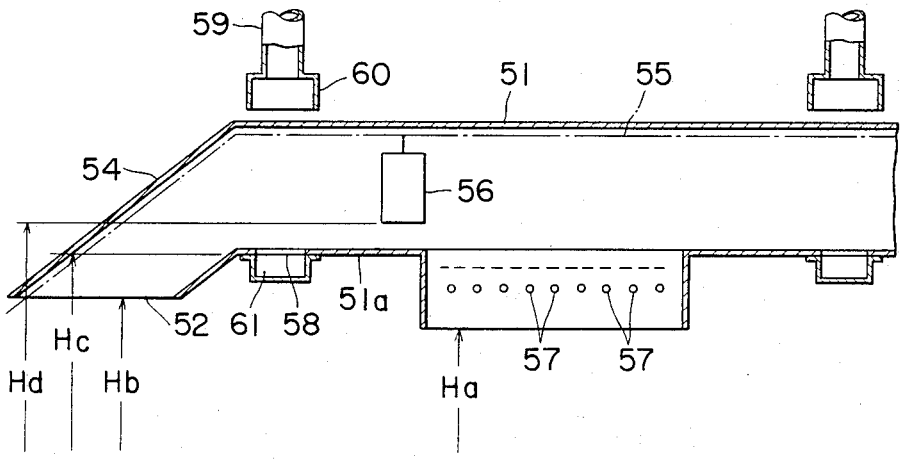
FIGS. 6 and 7 are longitudinal sectional views showing the heating surface of further embodiment of this invention.

FIG. 6 shows another embodiment of this invention. In this embodiments, the shielding plates 54 at an inlet port 52 and an outlet port, not shown, of a furnace 51 are extended beyond the bottom 51*a* of the furnace. The gas burners 57 are located beneath the furnace 51, and in the same manner as in the previous embodiment, the upper edge of the air supply opening is located beneath the lower edge of the shielding plate 54. Reference numeral 55 designates a conveyor line and 56 designates an article to be heated. The gas or air discharge port 58 opens in the bottom floor 51*a* of the furnace and communicates with the atmosphere through a duct 61. According to this construction, the whole interior of the furnace can be filled with hot gas. Accordingly, it is possible to reduce the vertical width of the furnace, thus decreasing the cost of installation and operating cost.

Figure 7:
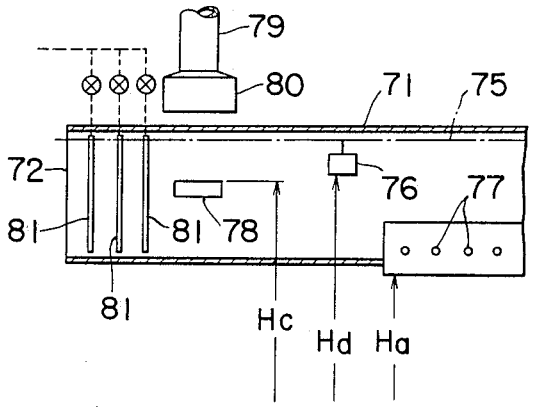
Figure 8:
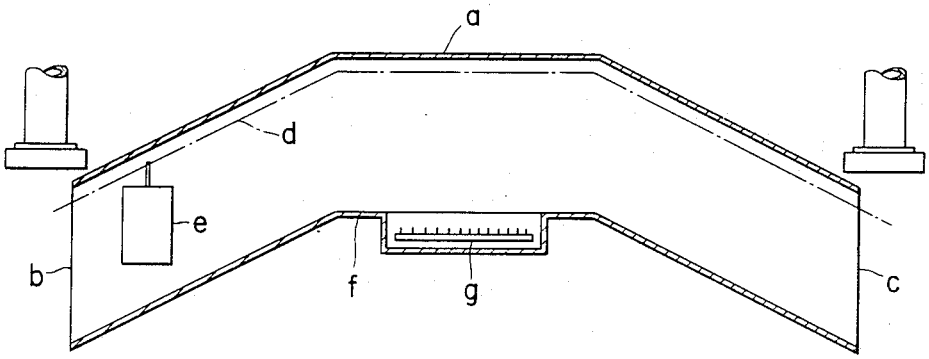
FIG. 8 PRIOR ART
FIG. 8 is a longitudinal sectional view showing one example of a prior art heating furnace.

In still further embodiment shown in FIG. 7, the inlet port 72 and the outlet port, not shown, of a furnace 71 are closed by air curtains 81 instead of the shielding plates. In this modification, a conveyor line 75 is installed to run straightforward. In the same manner as described above, the height Ha of the air supply port of the gas burner 77, the height Hc of the upper edge of the discharge port 78 and the height Hd of the lower edge of the article 76 to be heated are set to satisfy a relation $Ha < Hc \leqq Hd$.

As described above, according to this invention, in a heating furnace of the type wherein hot gas or air is generated in an inverted vessel type furnace so that the upper inner portion of the furnace is filled with high temperature gas to heat articles at high temperatures, an exhaust port, an inlet port and an output port are reasonably arranged so as to efficiently heat the articles with a minimum heat energy, thereby greatly decreasing the fuel consumption. In the heating furnace utilizing hot gas, gas circulating type heating furnaces have been used in most cases for efficiently utilizing heat energy. When compared with this conventional type heating furnace, the heating furnace of this invention can save special burner, fan or duct whereby the construction of the furnace can be simplified to decrease the cost of installation and operation. Moreover, since natural convection is utilized, replacement of used gas is made efficiently so that impurities contained in the gas can be effectively discharged. Thus at the time of baking films coated on the articles, there is no fear of contaminating the films. Moreover, as the flow speed of the hot gas is relatively slow, heating can be made gently and uniformly, thereby improving the quality of the heated articles.

What is claimed is:

1. A horizontal-type furnace for heating articles, comprising: an elongate horizontal heating chamber; wherein the height of the upper edges of the inlet and outlet ports from a horizontal reference plane is Hb, the height of the upper edges of the exhaust ports from the horizontal reference plane is Hc, and the height of the bottom edges of the articles from the horizontal reference plane during their conveyance through the enclosed heating zone is Hd, the furnace being dimensioned to satisfy the relationships Hb, Hc Hd having top and bottom portions and a pair of opposed side wall portions, the heating chamber having an inlet port at one horizontal end portion thereof for admitting articles to be heated into the heating chamber and an outlet port at the other horizontal end portion thereof for discharging heated articles from the heating chamber; cover members secured to respective end portions of the heating chamber and depending downwardly from the heating chamber top portion to define the upper edges of the inlet and outlet ports, the cover members jointly defining together with the heating chamber top portion and the upper parts of the heating chamber side wall portions an enclosed heating zone within the heating chamber situated entirely above the level of the upper edges of the inlet and outlet ports; means for introducing hot gas into the heating chamber at a level below the enclosed heating zone whereby the hot gas ascends by natural convection and circulates within the enclosed heating zone; discharging means comprised of a set of exhaust ports formed in the heating chamber side wall portions for discharging the hot gas after the same has been cooled, the exhaust ports having upper edges situated no lower than the upper edges of the inlet and outlet ports whereby the cooled hot gas descends by natural convection and exits through the exhaust ports; and conveying means for conveying the articles from the inlet port to the outlet port through the enclosed heating zone while maintaining the bottom edges of the articles at a level no lower than the upper edges of the exhaust ports during conveyance of the articles through the enclosed heating zone of the heating chamber.

2. A furnace according to claim 1; wherein the discharging means includes adjusting means for adjusting the size of the exhaust ports.

3. A furnace according to claim 1; wherein the discharging means includes an exhaust duct communicating with the heating chamber.

4. A furnace according to claim 1; including collecting means disposed adjacent to the discharging means for collecting the discharged gas.

5. A furnace according to claim 4; wherein the collecting means comprises a hood mounted above the discharging means, and a fan disposed inside the hood.

6. A furnace according to claim 1; wherein the means for introducing hot gas comprises a suction port for sucking air from the heating chamber, and means for heating the sucked air and introducing the heated air into the heating chamber.

7. A furnace according to claim 1; wherein the means for introducing hot gas comprises a gas burner mounted on the lower portion of the heating chamber.

8. A furnace according to claim 1; wherein the conveying means comprises a conveyor line disposed along the upper portion of the heating chamber for hanging the articles therefrom to position the articles within the enclosed heating zone.

* * * * *

UNITED STATES PATENT AND TRADEMARK OFFICE

CERTIFICATE OF CORRECTION

PATENT NO. : 4,964,799

DATED : October 23, 1990

INVENTOR(S) : Bunzo Hirano

It is certified that error appears in the above-identified patent and that said Letters Patent is hereby corrected as shown below:

Col. 5, (claim 1) line 56, through col. 6, line 3, cancel beginning with ";" wherein the height of the upper" to and including "to satisfy the relationships Hb, Hc Hd".

Col. 6, line 34, after "chamber" insert the following:
--; wherein the height of the upper edges of the inlet and outlet ports from a horizontal reference plane is Hb, the height of the upper edges of the exhaust ports from the horizontal reference plane is Hc, and the height of the bottom edges of the articles from the horizontal reference plane during their conveyance through the enclosed heating zone is Hd, the furnace being dimensioned to satisfy the relationships $Hb < Hc < Hd$--.

Signed and Sealed this

Twenty-second Day of September, 1992

*Attest:*

DOUGLAS B. COMER

*Attesting Officer*

*Acting Commissioner of Patents and Trademarks*